US005871369A

United States Patent [19]

Obayashi et al.

[11] Patent Number: 5,871,369

[45] Date of Patent: Feb. 16, 1999

[54] CONNECTOR

[75] Inventors: Katsuaki Obayashi, Yokohama; Eiji Kawabe, Sagamihara; Shuichi Endo, Fujisawa, all of Japan

[73] Assignee: I-PEX Co., Ltd., Tokyo, Japan

[21] Appl. No.: 798,730

[22] Filed: Feb. 13, 1997

[51] Int. Cl.[6] ..... H01R 9/07

[52] U.S. Cl. ..... 439/495; 439/656; 439/331

[58] Field of Search ..... 439/492, 493, 439/495, 499, 656, 331, 422

[56] References Cited

U.S. PATENT DOCUMENTS 3,702,982 11/1972 Kelly et al. ..... 439/422
4,555,157 11/1985 Johnson et al. ..... 439/331
4,586,768 5/1986 Eck ..... 439/460
4,639,063 1/1987 Mueller ..... 439/495
4,640,562 2/1987 Shoemaker ..... 439/495
5,211,577 5/1993 Daugherty ..... 439/493

*Primary Examiner*—Neil Abrams
*Assistant Examiner*—Brian J. Biggi
*Attorney, Agent, or Firm*—Diller, Ramik & Wight, PC

[57] ABSTRACT

A connector comprises a plurality of movable terminals, a a frame for holding the plurality of movable terminals in a row at prescribed intervals, a contact bar for joining under pressure the plurality of movable terminals and the terminal conductors of a cable disposed on the plurality of the movable terminals, and a cover for pressing the contact bar, whereby the cable is connected to the connector by a simple operation without the use of special tools.

14 Claims, 3 Drawing Sheets

CONNECTOR

BACKGROUND OF THE INVENTION

1. Field of the Invention

This invention relates to a connector used in the internal wiring of small-sized equipment, and more particularly to a connector for connecting flexible flat cables, tape cables and other flat multicore cables.

2. Description of Related Art

In the past, flexible flat cables, tape cables and other flat multicore cables (hereinafter "cables") have been used in the internal wiring of notebook computers and other types of small-sized equipment. In such cables, single wires, double wires, coaxial wires and other wiring materials are arranged in a row inside an insulator, and because the cable wiring is flexible, the advantage is that the density of wiring inside a device can be increased.

In the past, terminal conductors of such cables and electrode terminals on a substrate have been connected by crimping or coupling.

However, the crimping operation involves achieving connection by crimping the terminal conductor of a cable against an electrode terminal, and is thus disadvantageous in that it requires special tools and involves complicated mounting procedures. Coupling also requires special tools for crimping numerous conductors at the same time.

Thus, conventional connection processes are disadvantageous in that they require special tools for connecting electrode terminals and the terminal conductors of cables, and that mounting requires considerable time and labor.

SUMMARY OF THE INVENTION

An object of this invention is to provide a connector that does not require special tools and allows connection to be performed as a simple operation.

Aimed at attaining the stated object, the connector according to this invention comprises a plurality of movable terminals, a frame for holding the plurality of movable terminals in a row at prescribed intervals, a contact bar for joining under pressure the plurality of movable terminals and the terminal conductors of a cable disposed on the plurality of the movable terminals, and a cover for pressing the contact bar.

With such a connector, the movable terminals, which the terminal conductors of a cable are brought into contact with, are secured inside a frame, a contact bar is placed on top of these terminal conductors, and a cover member is mounted on top of the contact bar. When the cover member is mounted, the contact bar is pressed down by the cover member so that the contact portion between the terminal conductors and the movable terminals is joined under pressure by the elastic force of the movable terminals, thereby to establish electrical conductivity therebetween.

The connection of movable terminals and terminal conductors can therefore be completed by a simple procedure, that is, by bringing the terminal conductors into contact with the movable terminals on the frame, and by mounting the contact bar and the cover member on top thereof. This simple procedure makes it possible to perform connection without the need for the special tools or techniques required in the past to perform crimping.

Other objects and merits of this invention can be easily identified based on the following detailed description and attached drawings.

DESCRIPTION OF THE EMBODIMENTS

An embodiment of the connector according to this invention will now be described with reference to drawings. In this embodiment, the shapes, structures, numbers, and other parameters of components will be omitted or simplified as needed.

Figure 1:
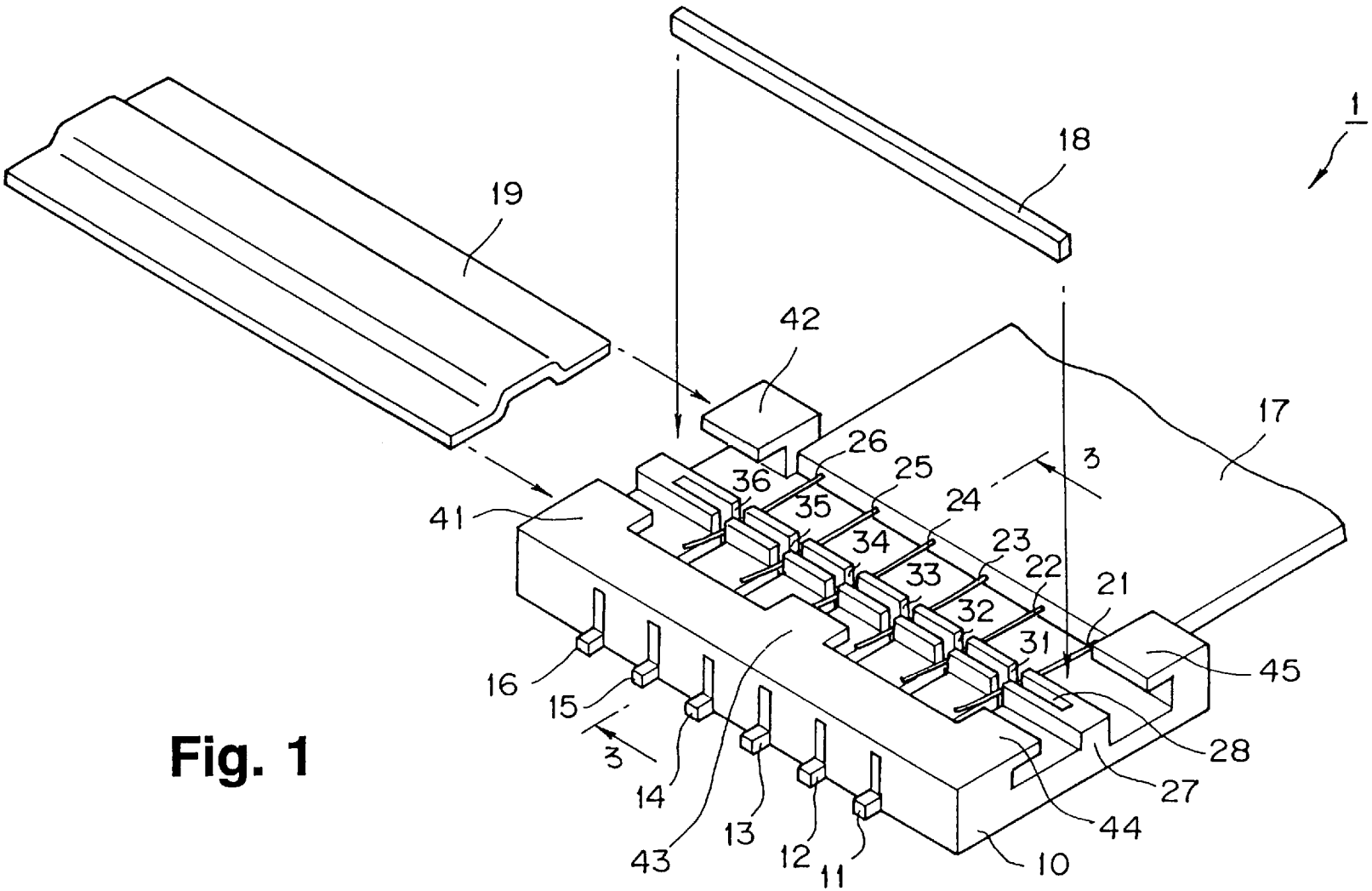
FIG. 1 is an exploded perspective view depicting an embodiment of the connector according to this invention.

Referring to FIG. 1, the connector 1 comprises a main body (frame) 10 fixed on a substrate (not shown); contacts (movable terminals) 11, 12, 13, 14, 15 and 16 arranged inside the main body 10; a contact bar 18 for joining under pressure the contacts 11 through 16 with conductors 21, 22, 23, 24, 25 and 26 formed at the terminal portions of a cable 17 to be connected; and a cover 19 arranged to press down the contact bar 18 when mounted to the main body 10.

Figure 2:
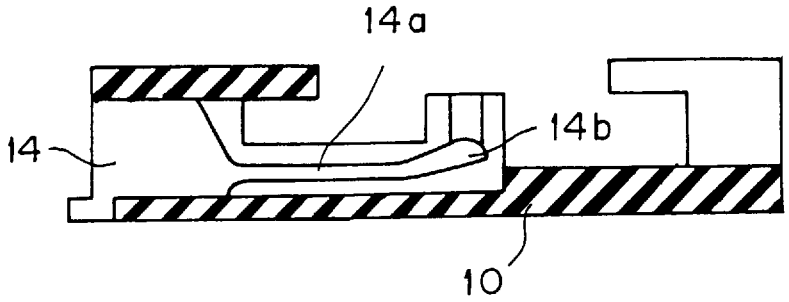
FIG. 2 is a schematic cross section of the connector taken generally along line 3—3 of FIG. 1.
Figure 3:
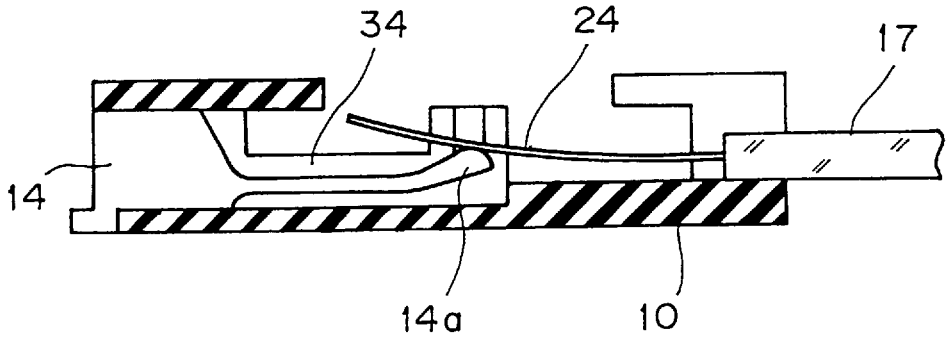
FIG. 3 is a schematic cross section of the connector taken generally along line 3—3 of FIG. 1, and illustrates the manner in which a cable is fitted into the connector.

The main body 10 is integrally formed from an insulating material, and the contacts 11, 12, 13, 14, 15 and 16 are arranged in a row inside the body at prescribed intervals. The shape of the contacts will be described using the contact 14 as an example. As shown in FIGS. 2 and 3, which are each a cross section taken generally along line 3—3 in FIG. 1, the contact 14 is embedded in a notch (described below) formed in the main body 10, and an electrode piece 14*b* for ensuring contact with the conductor 24 of the cable 17 is formed at the tip of a contact arm 14*a* projecting from one end. In FIG. 2, the contact arm 14*a* is bent downward in the drawing when pressed, and is provided with an elastic force that allows the arm to return to the position shown in the drawing when the pressure is released. Other contacts 11, 12, 13, 15 and 16 are provided in a similar manner with contact arms 11*a*, 12*a*, 13*a*, 15*a* and 16*a*, respectively, and with electrode pieces 11*b*, 12*b*, 13*b*, 15*b* and 16*b*, respectively, (not shown). In addition, each of the contacts 11 through 16 is electrically connected to the electrode terminals (not shown) on the substrate.

As is also shown in FIG. 1, a longitudinal ridge 27 is formed in the center of the main body 10, and a groove 28 for accommodating the contact bar 18 is formed in this ridge 27. In addition, notches 31, 32, 33, 34, 35 and 36 of prescribed groove width are formed in the ridge 27 and main body 10 at the same intervals as the contacts 11, 12, 13, 14, 15 and 16.

As shown in FIG. 2, the electrode pieces 11*b*, 12*b*, 13*b*, 14*b*, 15*b* and 16*b* are located inside the notches 31, 32, 33, 34, 35 and 36, and are positioned immediately below the groove 28.

Referring back to FIG. 1, the conductors 21, 22, 23, 24, 25 and 26 of the cable 17 are fitted into the notches 31, 32, 33, 34, 35 and 36, respectively, and are configured in such a way that contact is achieved with the electrode pieces 11*b*, 12*b*, 13*b*, 15*b* and 16*b* (FIG. 3). Each of the conductors fitted into the corresponding notches is restricted in its movement in the direction perpendicular to the axial direction thereof by the side walls of the notch, making it possible for the cable 17 to remain in contact with the electrode pieces as long as it does not separate from the main body 10.

The contact bar 18 is inserted into the groove 28 from above in the drawing after the conductors 21, 22, 23, 24, 25 and 26 of the cable 17 have been fitted into the notches 31, 32, 33, 34, 35 and 36.

In addition, tongues 41, 42, 43, 44 and 45 for engagement with the two lateral edges of the cover 19 in the longitudinal direction extend in the direction of the groove 28 from the two ends in the longitudinal direction of the main body 10. The cover 19, which is made of a metallic material mechanically worked to a roughly convex shape in cross section, is inserted into the main body 10 from the side (with respect to the drawing) after the contact bar 18 has been placed inside the groove 28. In the process, the lateral edges of the cover 19 and the tongues 41, 42, 43, 44 and 45 sequentially engage each other, and the cover 19 is thus mounted in the main body 10. Once the cover 19 has been mounted in the main body 10, the contact bar 18 is pressed down underneath the cover 19, whereby the contact arms 11*a*, 12*a*, 13*a*, 14*a*, 15*a* and 16*a* (not shown) are bent down; the conductors 21, 22, 23, 24, 25 and 26 and the electrode pieces 11*b*, 12*b*, 13*b*, 14*b*, 15*b* and 16*b* (not shown) are joined under pressure by the elastic force of the contact arms; and electrical connection is established between the two.

The conductors 21, 22, 23, 24, 25 and 26 and the electrode pieces 11*b*, 12*b*, 13*b*, 14*b* 15*b* and 16*b* are electrically insulated from the cover 19 composed of a metallic material by the contact bar 18 composed of an insulating material.

The sequence adopted for connecting the cable 17 to the connector 1 and the operation of each component will now be described in detail with reference to FIGS. 2 through 5, which are cross sectional views taken along line 3—3 of FIG. 1, and with reference to FIG. 6. In FIGS. 2 through 5, the description will be given using connection between the contact 14 and the conductor 24 as an example.

First, as shown in FIG. 3, the end of the cable 17 is placed at the lateral end (right end in FIG. 2) of the main body 10 in the state shown in FIG. 2, and the conductors 21, 22, 23, 24, 25 and 26 are fitted into the notches 31, 32, 33, 34, 35 and 36. As a result, the conductor 24 is brought into contact with the electrode piece 14*b*.

Figure 4:
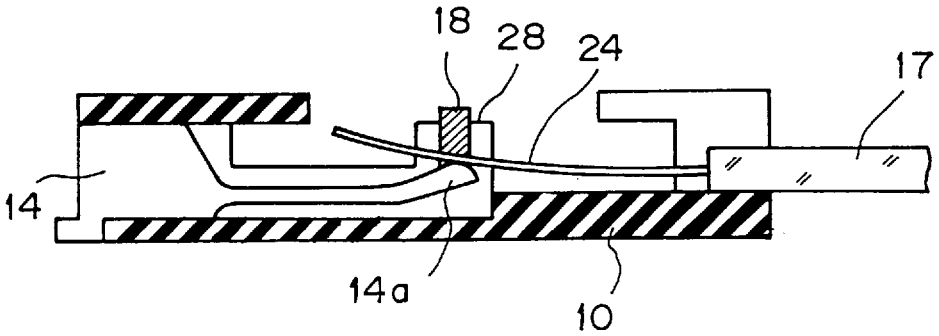
FIG. 4 is a schematic cross section depicting the manner in which a contact bar is housed.

The contact bar 18 is then placed inside the groove 28, as shown in FIG. 4. As a result, the contact bar 18 is disposed in a direction roughly perpendicular to the axial direction of the conductors 21 through 26 of the cable 17, as shown in FIG. 1.

The cover 19 is subsequently inserted from the side of the main body 10, as shown in FIG. 1. The insertion is accompanied by the sequential engagement of the two lateral edges in the longitudinal direction of the cover 19 with the tongues 41, 42, 43, 44 and 45 of the main body 10.

Figure 5:
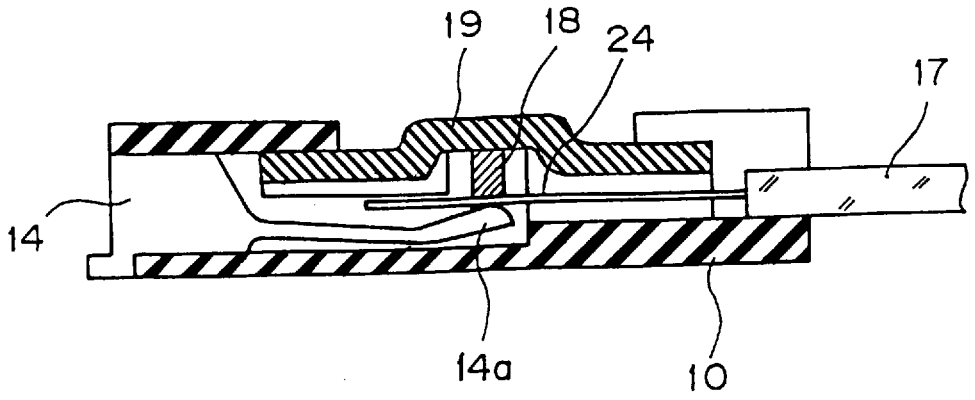
FIG. 5 is a schematic cross section depicting the manner in which a cover is mounted.

Because, as shown in FIG. 5, the cover 19 slides over the upper surface of the contact bar 18 while pressing it down, the contact arm 14*a* is bent down by the contact bar 18 being pushed downward, the conductor 24 and the electrode piece 14*b* are joined under pressure by an elastic force that tries to return the contact arm 14*a* to the position of FIG. 2, and an electric contact is established.

Other conductors 21, 22, 23, 25 and 26, as well as electrode pieces 11*b*, 12*b*, 13*b*, 15*b* and 16*b* (not shown), are joined under pressure and connected together by the same action as in FIGS. 2 through 5.

Figure 6:
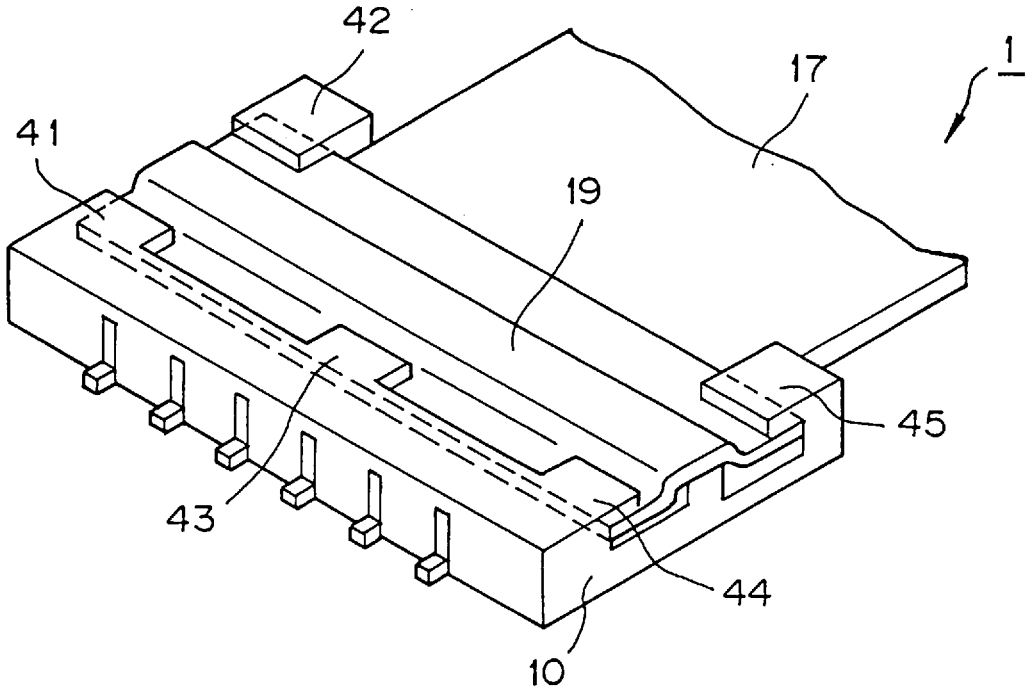
FIG. 6 is a schematic perspective view depicting the manner in which the cover is mounted.

As shown by the schematic perspective view in FIG. 6, once the cover 19 has been inserted until all the tongues 41, 42, 43, 44 and 45 are engaged with the lateral edges of the cover 19, the cover 19 is completely mounted in the main body 10, and the connection between the connector 1 and the cable 17 is completed.

Thus, once the cover 19 has been completely mounted in the main body 10, the upward movement of the cover 19 is restricted by the tongues 41, 42, 43, 44 and 45, and because the cover is in engagement with the tongues while being pressed upward, the cable 17 is essentially prevented from being pulled out by tension in the axial direction of each conductor, and the cable 17 is firmly connected to the connector 1.

To disconnect the cable 17 from the connector 1, one should disassemble the components in reverse order with respect to the sequence described above. Specifically, the cover 19 is slidably removed and detached from the main body 10 in either longitudinal direction. The cable 17 is subsequently separated from the main body 10 by the removal of the contact bar 18 from the groove 28. The contact bar 18 and cover 19 thus separated can be used repeatedly because they are not subjected to outside forces capable of producing permanent deformation during attachment to and detachment from the main body 10.

The connector 1 of the above-described embodiment thus allows the cable 17 to be connected to the connector 1 by a simple procedure of merely bringing the conductors of the cable 17 into contact with the electrode pieces of the main body 10, and mounting the contact bar 18 and the cover 19 to the main body 10. In addition, there is no need to prepare special tools for the crimping of the cable conductors and the contact during connection. Further, the contact bar 18, cover 19 and other constituent components can be used repeatedly.

In the embodiment described above, the shape of the contacts 11 through 16 is not limited by the shape described, and can have any configuration as long as it is a structure that possesses elastic force at least in one direction. In addition, the method of engagement between the cover 19 and the main body 10 is not limited by the example shown, and other methods can be adopted as long as they are capable of pressing and fixing the contact bar 18.

Furthermore, the connector according to this invention can be applied not only to flexible flat cables or tape cables but also, for example, to flexible printed circuits (FPC) and other printed substrates having flexibility.

As described above, with the connector according to this invention, the movable terminals inside a frame and the terminal conductors of a cable are brought into contact, a contact bar is placed on top of the conductors, and this contact bar is then pressed down with a cover member to join the movable terminals and conductors under pressure, thus dispensing with the need for special tools to connect the terminal conductors and the movable terminals and making it possible to connect or separate the movable terminals and the terminal conductors of a cable by a very simple procedure.

In this invention, various other embodiments can be implemented without departing from the spirit and principal features thereof. In view of this, the embodiments described above merely serve to illustrate various points and should not be interpreted as restrictive. The scope of this invention is defined in the claims and is not in any way restricted to the wording of the Specification. In addition, any and all modifications or changes belonging to claims that are equivalent to the present claims shall fall within the scope of this invention.

What is claimed is:

1. A connector comprising a plurality of movable terminals (11–16) capable of elastic movement in at least one direction; a frame (10) of insulating material having a groove (28) positioned substantially normal to axes of said movable terminals (11–16) and substantially parallel to a longitudinal axis of said frame (10), a plurality of grooves (31–36) substantially normal to and spanning said first-mentioned groove (28), a plurality of conductors (21–26) of a cable (17) being located one each in said plurality of grooves (31–36) and upon said movable terminals (11–16), a contact rod (18) of insulating material being seated in said first-mentioned groove (28) in spanning relationship to said plurality of conductors (21–26), a cover member (19), and means (41, 42, 44, 45) for retaining said cover member (19) upon said frame (10) in pressing engagement with said rod (18) which bears against said plurality of conductors (21–26) which in turn bear against said movable terminals (11–16).

2. The connector as defined in claim 1 wherein said movable terminals (11–16) are supported in cantilevered relationship by said frame (10) with ends of said movable terminals (11–16) being located in opposing relationship to said rod (18).

3. The connector as defined in claim 2 wherein said cover retaining means (41, 42, 44, 45) include pairs (41, 42 and 44, 45) of transversely opposing tongues (41, 42, 44, 45) at longitudinally opposite ends of said frame (10), and longitudinal edge portions of said cover member (19) are in underlying sliding relationship to said pairs (41, 42; 44, 45) of tongues (41, 42, 44, 45).

4. The connector as defined in claim 3 wherein said member (19) includes a longitudinal channel within which said rod (18) is at least partially received.

5. The connector as defined in claim 3 wherein said frame (10) includes a central longitudinal ridge (27), and said first-mentioned groove (28) and said plurality of grooves (31–36) are formed in said central longitudinal ridge (27).

6. The connector as defined in claim 2 wherein said cover member (19) is made of metallic material.

7. The connector as defined in claim 2 wherein said member (19) includes a longitudinal channel with which said rod (18) is at least partially received.

8. The connector as defined in claim 2 wherein said frame (10) includes a central longitudinal ridge (27), and said first-mentioned groove (28) and said plurality of grooves (31–36) are formed in said central longitudinal ridge (27).

9. The connector as defined in claim 1 wherein said cover retaining means (41, 42, 44; 45) include pairs (41, 42 and 44, 45) of transversely opposing tongues (41, 42, 44, 45) at longitudinally opposite ends of said frame (10), and longitudinal edge portions of said cover member (19) are in underlying sliding relationship to said pairs (41, 42; 44, 45) of tongues (41, 42, 44, 45).

10. The connector as defined in claim 9 wherein said member (19) includes a longitudinal channel with which said rod (18) is at least partially received.

11. The connector as defined in claim 9 wherein said frame (10) includes a central longitudinal ridge (27), and said first-mentioned groove (28) and said plurality of grooves (31–36) are formed in said central longitudinal ridge (27).

12. The connector as defined in claim 1 wherein said cover member (19) is made of metallic material.

13. The connector as defined in claim 1 wherein said member (19) includes a longitudinal channel within which said rod (18) is at least partially received.

14. The connector as defined in claim 1 wherein said frame (10) includes a central longitudinal ridge (27), and said first-mentioned groove (28) and said plurality of grooves (31–36) are formed in said central longitudinal ridge (27).

* * * * *